US008314742B2

(12) United States Patent
Fujita

(10) Patent No.: US 8,314,742 B2
(45) Date of Patent: Nov. 20, 2012

(54) ANTENNA DEVICE WITH LENS OR PASSIVE ELEMENT ACTING AS LENS

(75) Inventor: Akihisa Fujita, Anjo (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 558 days.

(21) Appl. No.: 12/563,306

(22) Filed: Sep. 21, 2009

(65) Prior Publication Data

US 2010/0073260 A1 Mar. 25, 2010

(30) Foreign Application Priority Data

Sep. 22, 2008 (JP) ..... 2008-243147

(51) Int. Cl.
*H01Q 19/06* (2006.01)

(52) U.S. Cl. ..... 343/754; 343/911 R; 342/368

(58) Field of Classification Search ..... 343/753, 343/754, 911 R, 911 L, 853; 342/368, 371, 342/375, 147

See application file for complete search history.

(56) References Cited

U.S. PATENT DOCUMENTS

| | | | | |
|---|---|---|---|---|
| 4,121,221 | A * | 10/1978 | Meadows | 342/374 |
| 4,335,388 | A * | 6/1982 | Scott et al. | 342/379 |
| 4,878,062 | A * | 10/1989 | Craven et al. | 343/872 |
| 5,128,687 | A * | 7/1992 | Fay | 343/754 |
| 6,130,653 | A * | 10/2000 | Powers et al. | 343/911 R |
| 6,606,056 | B2 * | 8/2003 | Brogden | 342/372 |
| 2006/0126571 | A1 | 6/2006 | Yuanzhu | |

FOREIGN PATENT DOCUMENTS

| | | |
|---|---|---|
| JP | 54-106153 | 8/1979 |
| JP | 11-068455 | 3/1999 |
| JP | 2000-341049 | 12/2000 |
| JP | 2001-127537 | 5/2001 |
| JP | 2003-152422 | 5/2003 |
| JP | 2006-173920 | 6/2006 |
| JP | 2007-221557 | 8/2007 |

OTHER PUBLICATIONS

Japanese Office Action dated Mar. 1, 2011, issued in corresponding Japanese Application No. 2008-243147, with English translation.

Japanese Office Action dated Jul. 27, 2010, issued in corresponding Japanese Application No. 2008-243147, with English translation.

* cited by examiner

*Primary Examiner* — Michael C Wimer

(74) *Attorney, Agent, or Firm* — Nixon & Vanderhye PC

(57) ABSTRACT

An antenna device has a divider producing first and second signals, and amplifiers amplifying the signals at a changeable amplitude ratio of the first signal to the second signal. A Rotman lens gives first phase differences to first high frequency waves, produced from the first amplified signal at an input port and transmitted to output ports, and gives second phase differences to second high frequency waves produced from the second amplified signal at another input port and transmitted to the output ports. An antenna forms a beam composed of electromagnetic waves, having the first phase differences and electric power corresponding to the first amplified signal on an antenna surface, and electromagnetic waves, having the second phase differences and electric power corresponding to the second amplified signal on the antenna surface, and radiates the beam in a particular direction corresponding to the phase differences and the amplitude ratio.

7 Claims, 9 Drawing Sheets

ANTENNA DEVICE WITH LENS OR PASSIVE ELEMENT ACTING AS LENS

CROSS-REFERENCE TO RELATED APPLICATION

This application is based upon and claims the benefit of priority of the prior Japanese Patent Application 2008-243147, filed on Sep. 22, 2008, so that the contents of which are incorporated herein by reference.

BACKGROUND

1. Technical Field

The present application relates to an antenna device which forms a beam having a radiation direction freely set by using a lens or a passive element acting as a lens, radiates the beam in the radiation direction and receives the beam reflected by an object to detect the bearing angle to the object.

2. Description of Related Art

An antenna device has been used to radiate a beam of electromagnetic waves while scanning the beam within a predetermined range of scanning angle. Further, this device receives the beam reflected by an object to detect the bearing angle to the object.

For example, a well-known Rotman lens with a Rotman lens pattern acting as wave-guiding channels is used for the antenna device. In this lens, electromagnetic waves induced from a transmission signal are distributed to form a beam directed in a radiation direction, and electromagnetic waves of an incoming beam are combined with one another to produce a reception signal indicating the incoming direction of the beam.

This Rotman lens has a channel pattern, a plurality of antenna ports disposed on one side of the lens, and a plurality of beam ports disposed on another side of the lens. In response to a transmission signal, electromagnetic waves are induced at one specified beam port by magnetic coupling, the induced waves are distributed to the antenna ports through respective channels having different lengths. Therefore, the groups of waves at the antenna ports have respective phases different from one another. In response to these waves at the antenna ports, an array antenna having antenna elements connected with the respective antenna ports forms a transmitting beam. This beam is composed of groups of electromagnetic waves having phase differences. Then, the array antenna radiates this beam in a radiation direction corresponding to these phase differences.

Therefore, each beam port corresponds to one radiation direction of the beam, and the antenna device can radiate a beam in any of radiation directions corresponding to the beam ports.

The antenna device further has a receiving antenna array and a Rotman lens in a beam receiving block. This lens has antenna ports and beam ports. When an incoming beam comes to this antenna array from an incoming direction, antenna elements of the array receive respective groups of electromagnetic waves composing this beam on an antenna surface. The groups of electromagnetic waves at the antenna elements have phase differences corresponding to the incoming direction. Then, in response to this beam, groups of electromagnetic waves having these phase differences are induced at the antenna ports of the Rotman lens by magnetic coupling and are transmitted through respective channels having different lengths to have the same phase at one beam port corresponding to the phase differences. That is, the group of induced waves are combined with one another at the beam port, and a reception signal is produced from the combined waves at the beam port. Because the phase differences of the groups of waves composing the beam corresponds to the incoming direction, each beam port of the lens corresponds to one incoming direction of the beam. Therefore, the antenna device can receive a beam coming from any of incoming directions corresponding to the beam ports.

Accordingly, the antenna device can detect the bearing angle to an object from the reception signal which is produced from a beam coming from any of directions corresponding to the beam ports.

The antenna device performs the beam scanning to radiate a beam, formed by using the Rotman lens, at a scanned angle denoting the radiation direction while changing the scanned angle with respect to time. The number of scanned angles is equal to the number of beam ports. Therefore, the scanned angles are discretely set, and the antenna device performs bearing detection while discretely changing the scanned angle of the scanning beam. In this case, the bearing resolution undesirably becomes low. To heighten this resolution, it is required to increase the number of beam ports. However, the size of the Rotman lens is increased with the number of beam ports, so that it is difficult to manufacture a small-sized antenna device while heightening the bearing resolution in the bearing detection.

To solve this problem, Published Japanese Patent First Publication No. 2003-152422 has proposed an antenna array device. A beam radiated in a particular direction generally has a radiation pattern of electric power with respect to the radiation direction. That is, radiation energy of the beam is maximized in that particular direction, and the beam has also radiation energy in directions surrounding the particular direction. In this device, two beam ports adjacent to each other are changeably selected from many beam ports of a Rotman lens, electromagnetic waves distributed from one selected beam port to antenna ports of the Rotman lens are added with electromagnetic waves distributed from the other selected beam port to the antenna ports, and a transmitting beam induced from the added waves is radiated. Therefore, the beam has a radiation pattern having the maximum radiation energy in the first direction corresponding to one selected beam port and another radiation pattern having the maximum radiation energy in the second direction corresponding to the other selected beam port. The sum of the radiation patterns has a composite pattern having the maximum radiation energy in a third direction placed between the first and second directions. Therefore, the transmitting beam is substantially radiated in the third direction.

Therefore, this conventional device can set scanned angles of which the number is larger than the number of beam ports. Further, this conventional device can also detect each of received beams coming from different directions of which the number is larger than the number of beam ports. Accordingly, the bearing resolution can be heightened in the bearing detection without increasing the number of beam ports.

However, this conventional device requires many selecting switches and a selection controller to appropriately select two beam ports from a large number of beam ports. Because the selection of the beam ports is performed in a cycle corresponding to a frequency in a wide frequency band from several hundreds MHz to tens GHz, it is difficult to manufacture many switches operable in this operating cycle with uniform characteristics. Therefore, it is difficult to manufacture the conventional device operable with high precision.

BRIEF SUMMARY

An object of the present exemplary embodiment is to provide, with due consideration to the drawbacks of the conventional antenna array device, an antenna device which radiates a beam in any direction freely set in a simple structure while using a lens or a passive element having the same function as the function of the lens.

Another object of the present exemplary embodiment is to provide an antenna device which receives a beam coming from any direction in a simple structure while using a lens or a passive element having the same function as the function of the lens.

According to an aspect of this exemplary embodiment, the object is achieved by the provision of an antenna device, comprising a transmission signal producing unit, a transmission signal adjusting unit and a beam forming unit. The producing unit produces a first transmission signal and a second transmission signal. The adjusting unit adjusts the first transmission signal produced by the signal producing unit to have a first amplitude or a first phase and adjusts the second transmission signal produced by the signal producing unit to have a second amplitude or a second phase. The forming unit has a first input portion from which first electromagnetic waves having an amplitude or a phase corresponding to the first amplitude or the first phase of the first transmission signal are transmitted, a second input portion from which second electromagnetic waves having an amplitude or a phase corresponding to the second amplitude or the second phase of the second transmission signal are transmitted, an output portion at which the first electromagnetic waves transmitted from the first input portion have first phase differences while the second electromagnetic waves transmitted from the second input portion have second phase differences, and an antenna surface on which a particular beam, composed of a first portion of electromagnetic waves having the first phase differences and electric power corresponding to electric power of the first electromagnetic waves and a second portion of electromagnetic waves having the second phase differences and electric power corresponding to electric power of the second electromagnetic waves, is formed, and from which the particular beam is radiated in a particular direction based on the first phase differences and the electric power of the first portion of electromagnetic waves and the second phase differences and the electric power of the second portion of electromagnetic waves.

With this structure of the antenna device, amplitudes or phases of transmission signals are adjusted in the adjusting unit. The beam forming unit has a lens or a passive element acting as a lens. In this unit, first electromagnetic waves are produced at the first input portion so as to have amplitude or phase corresponding to the first amplitude or the first phase of the first transmission signal, and are transmitted to the output portion to have the first phase differences. In the same manner, second electromagnetic waves are produced at the second input portion so as to have amplitude or phase corresponding to the second amplitude or the second phase of the second transmission signal, and are transmitted to the output portion to have the second phase differences. Then, the beam forming unit forms a particular beam from the first and second electromagnetic waves. This beam is composed of a first portion of electromagnetic waves having the first phase differences and electric power corresponding to electric power of the first electromagnetic waves and a second portion of electromagnetic waves having the second phase differences and electric power corresponding to power of the second electromagnetic waves. Then, the particular beam is radiated in a particular direction. This direction is determined on the basis of the first phase differences and the electric power of the first portion of electromagnetic waves and the second phase differences and the electric power of the second portion of electromagnetic waves.

Because the second input portion differs from the first input portion, the first phase differences are differentiated from the second phase differences. In this case, the first portion of electromagnetic waves in the beam has propagation directions centered on a first direction, and the second portion of electromagnetic waves in the beam has propagation directions centered on a second direction different from the first direction.

Further, amplitudes or phases of the first and second transmission signals are independently adjusted by the transmission signal adjusting unit. When amplitudes of the first and second transmission signals are adjusted, the amplitude ratio of the first portion of electromagnetic waves in the beam to the second portion of electromagnetic waves in the beam depends on this amplitude adjustment. Therefore, the particular direction of the particular beam can be adjustably set between the first and second directions. When phases of the first and second transmission signals are adjusted, the phase of electromagnetic waves composing the beam depends on this phase adjustment. Therefore, the particular direction of the particular beam can be adjustably set between the first and second directions or can be adjustably set outside the direction range between the first and second directions.

Accordingly, because the beam forming unit requires only two input portions, from which the transmission of electromagnetic waves is started, to form the particular beam radiated in the particular direction, the antenna device can radiate a beam in any direction freely set in a simple structure while using a lens or a passive element having the same function as the function of the lens.

According to another aspect of this exemplary embodiment, the object is achieved by the provision of an antenna device, comprising a beam receiving unit, a composite signal adjusting unit and a reception signal producing unit. The receiving unit has an antenna surface on which an incoming beam, composed of a first portion of electromagnetic waves having first phase differences and a second portion of electromagnetic waves having second phase differences different from the first phase differences, is received, an input portion from which first electromagnetic waves having the first phase differences and electric power corresponding to electric power of the first portion of electromagnetic waves in the beam and second electromagnetic waves having the second phase differences and electric power corresponding to electric power of the second portion of electromagnetic waves in the beam are transmitted, a first output portion at which the first electromagnetic waves transmitted from the input portion has a phase and a first composite signal is produced from the first electromagnetic waves to have a first amplitude and a first phase corresponding to an amplitude and phase of the first electromagnetic waves, and a second output portion at which the second electromagnetic waves transmitted from the input portion has a phase and a second composite signal is produced from the second electromagnetic waves to have a second amplitude and a second phase corresponding to an amplitude and phase of the second electromagnetic waves. The adjusting unit adjusts the amplitudes or phases of the first and second composite signals. The producing unit produces a reception signal providing information about an object, from which the incoming beam comes, from the first and second composite signals adjusted by the composite signal adjusting unit to detect the information of the object.

With this structure of the antenna device, the beam receiving unit is formed of a lens or a passive element acting as a lens. When an incoming beam is received on the antenna surface, first electromagnetic waves are produced at the input portion to have first phase differences and electric power corresponding to electric power of a first portion of electromagnetic waves having the first phase differences in the beam, and the first electromagnetic waves are transmitted to the first output portion to have the same phase. Further, second electromagnetic waves are produced at the input portion to have second phase differences and electric power corresponding to electric power of a second portion of electromagnetic waves having the second phase differences in the beam, and the second electromagnetic waves are transmitted to the second output portion to have the same phase.

Then, at the first output portion, a first composite signal is produced from the first electromagnetic waves to have a first amplitude and a first phase corresponding to an amplitude and the phase of the first electromagnetic waves. Further, at the second output portion, a second composite signal is produced from the second electromagnetic waves to have a second amplitude and a second phase corresponding to an amplitude and the phase of the second electromagnetic waves.

The amplitude and phase of the first composite signal correspond to those of the first portion of electromagnetic waves in the incoming beam, and the amplitude and phase of the second composite signal correspond to those of the second portion of electromagnetic waves in the incoming beam. Therefore, the amplitudes and phases of the composite signals indicate an incoming direction of the beam.

Then, the adjusting unit appropriately adjusts the amplitudes or phases of the composite signals, and the producing unit produces a reception signal having information about an object from the adjusted composite signals.

Because the adjusting unit appropriately adjusts the composite signals, the information of the object such as speed and distance of the object relative to the antenna device at a bearing angle to the object corresponding to the incoming direction of the beam can be obtained.

Accordingly, because the number of output portions is two in the antenna device, the antenna device can receive a beam coming from any direction in a simple structure while using a lens or a passive element having the same function as the function of the lens.

DETAILED DESCRIPTION OF THE PREFERRED EMBODIMENTS

Figure 1:
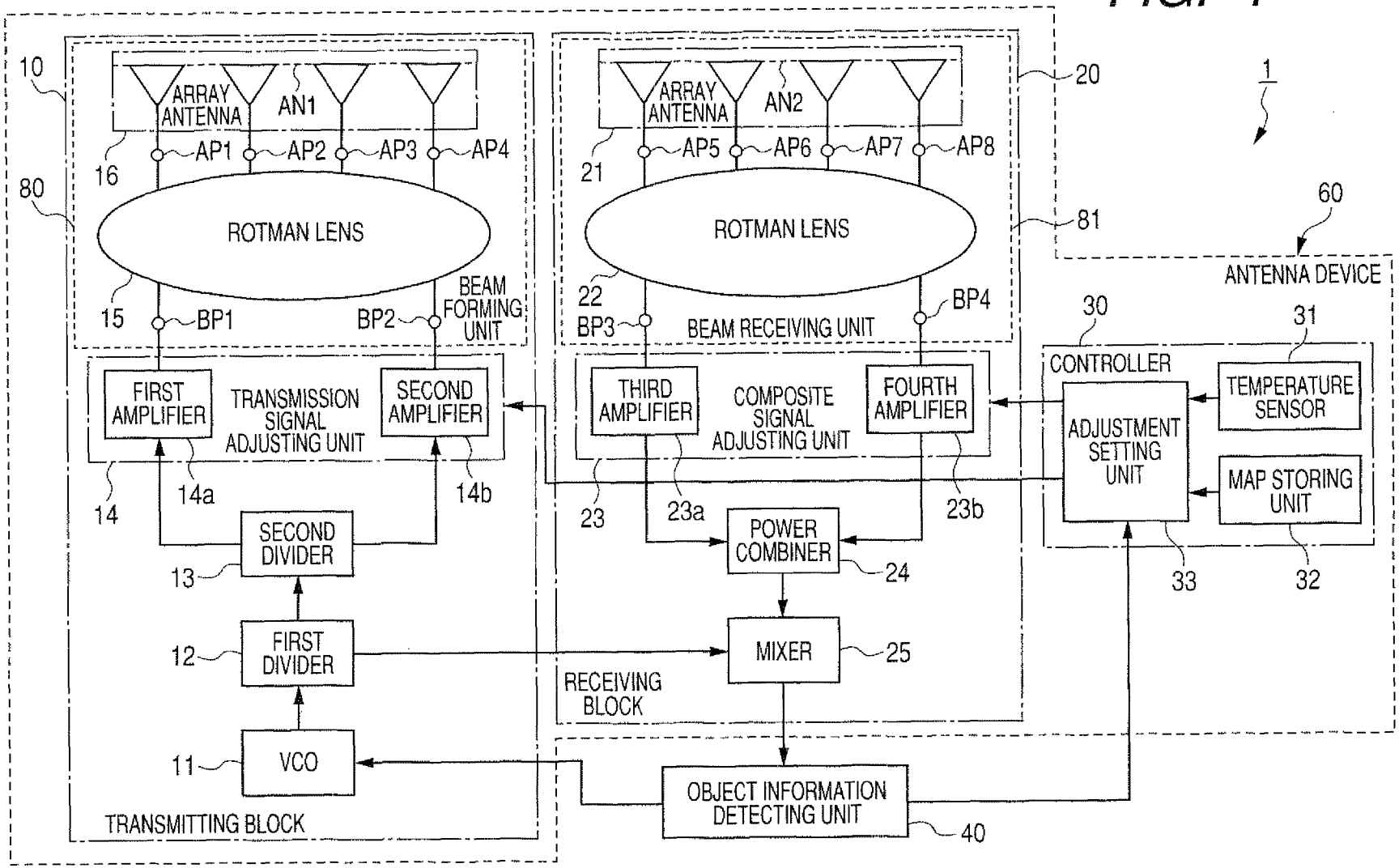
FIG. 1 is a block diagram of a radar apparatus having an antenna device according to the first embodiment of the present invention.

Embodiments of the present invention will now be described with reference to the accompanying drawings, in which like reference numerals indicate like parts, members or elements throughout the specification unless otherwise indicated.

First Embodiment

An antenna device disposed in a radar apparatus will be described. FIG. 1 is a block diagram of a radar apparatus having an antenna device according to the first embodiment.

As shown in FIG. 1, a radar apparatus 1 has an antenna device 60 for forming and radiating a radar beam and receiving the radar beam from an object, which reflects the radiated beam toward the device 60, and an object information detecting unit 40.

The antenna device 60 has a transmitting block 10 for transmitting a radar beam of frequency-modulated continuous waves (FMCW) having directivity according to a transmission signal while changing the radiation direction of the beam in a predetermined cycle within a predetermined direction range, a receiving block 20 for receiving the radar beam reflected by the object and producing a reception signal, indicating information about the object, from the received beam, and a beam controller 30 for controlling the transmitting block 10 to adjustably set the radiation direction of the radar beam while changing the radiation direction in the predetermined cycle and controlling the receiving block 20 to appropriately produce the reception signal from the received beam.

The object information detecting unit 40 supplies an instruction to the block 10 as the transmission signal, supplies a beam instruction specifying the radiation direction of the radar beam to the controller 30, and detects information regarding the object from the reception signal produced in the block 20.

This radar apparatus 1 is, for example, disposed on the front portion of a vehicle. When the radar beam radiated in a particular direction is reflected by the object and is returned to the device 60 from the particular direction, the detecting unit 40, for example, detects the speed of the vehicle relative to the object and the distance between the vehicle and object from the reception signal in addition to a particular bearing angle to the object corresponding to the particular direction.

The transmitting block 10 has a voltage control oscillator (VCO) 11 for generating a high frequency signal in response to an instruction of the detecting unit 40, a first divider 12 for dividing electric power of the high frequency signal into first and second portions and producing a local signal from the second portion of electric power, a second divider 13 for equally dividing the first portion of electric power into two to produce a first transmission signal and a second transmission signal having the same amplitude and the same phase, a transmission signal adjusting unit 14 for receiving the transmission signals having the same amplitude and the same phase from the divider 13 and independently amplifying the transmission signals, and a beam forming unit 80.

This forming unit 80 produces first high frequency waves (i.e., electromagnetic waves) having electric power and phase corresponding to electric power and phase of the first transmission signal amplified in the adjusting unit 14 at a first input portion, and transmits the first high frequency waves to an output portion to give first phase differences to the first high frequency waves. Further, the forming unit 80 produces second high frequency waves having electric power and phase corresponding to electric power and phase of the second transmission signal amplified in the adjusting unit 14 at a second input portion, and transmits the second high frequency waves to the output portion to give second phase differences to the second high frequency waves. The forming unit 80 forms a particular beam on an antenna surface and radiates this beam in a particular direction. This beam is composed of a first portion of electromagnetic waves having the first phase differences and electric power corresponding to electric power of the first electromagnetic waves and a second portion of electromagnetic waves having the second phase differences and electric power corresponding to electric power of the second electromagnetic waves. The particular direction of the beam is determined by the first phase differences and the electric power of the first portion of electromagnetic waves and the second phase differences and the electric power of the second portion of electromagnetic waves.

The high frequency signal of the VCO 11 is frequency-modulated so as to have the center frequency F0 (e.g., 76 GHz).

Figure 2:
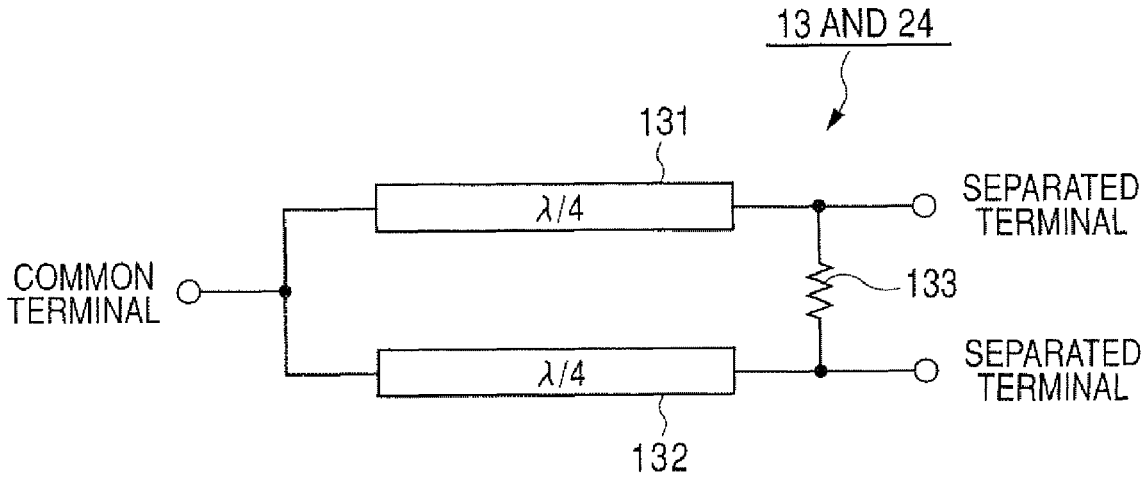
FIG. 2 is a view showing the structure of the Wilkinson power divider disposed in the radar apparatus shown in FIG. 1.

FIG. 2 is a view showing the structure of the divider 13. As shown in FIG. 2, the divider 13 has a pair of transmission lines 131 and 132 such as micro strip lines and a resistive element 133. Each of the transmission lines 131 and 132 has the length of $\lambda/4$. $\lambda$ denotes the wavelength of the high frequency signal corresponding to the center frequency F0. One end of the transmission line 131 and one end of the transmission line 132 are connected with a common terminal. The other ends of the transmissions 131 and 132 are connected with respective ends of the resistive element 133. Further, the other end of the transmission line 131 is connected with a first separated terminal, and the other end of the transmission line 132 is connected with a second separated terminal. Therefore, a so-called Wilkinson power divider is used as the divider 13.

The first portion of electric power in the first divider 12 is received at the common terminal of the second divider 13, and the transmission signals of the second divider 13 are transmitted to the adjusting unit 14 through the respective separated terminals.

The adjusting unit 14 has a first variable amplifier 14*a* and a second variable amplifier 14*b*. The variable amplifier 14*a* sets a first variable amplification factor (i.e., first variable gain) according to an instruction of the controller 30, and amplifies the first transmission signal by the factor to produce the first transmission signal having a first amplitude. The amplifier 14*h* sets a second variable amplification factor (i.e., second variable gain) according to an instruction of the controller 30 and amplifying the second transmission signal by the factor to produce the second transmission signal having a second amplitude. The ratio of the first amplification factor to the second amplification factor is changeably set.

Two transmission lines, respectively, connecting the separated terminals of the divider 13 and the amplifiers 14*a* and 14*b* have the same length. Therefore, the amplifiers 14*a* and 14*b* can receive the transmission signals having the same amplitude and phase.

The forming unit 30 has a Rotman lens 15, having two transmission beam ports BP (BP1 and BP2) and a plurality of antenna ports AP (e.g., four antenna ports AP1, AP2, AP3 and AP4), and a transmission array antenna 16 having a plurality of antenna elements, (e.g., four antenna elements) connected with the respective antenna ports AP. The Rotman lens 15 is a passive element acting as a lens. The beam ports BP (i.e., input portions) are placed on one side of the lens 15 and are spaced from each other at a predetermined interval. The antenna ports AP (i.e., output portion) are placed on the other side of the lens 15 and are spaced from one another at predetermined intervals. Each beam port SP is spaced from the antenna ports AP through wave-guiding channels of the lens 15 at different intervals. The antenna elements of the array antenna 16 are aligned on an antenna surface AN1 at equal intervals.

In response to the first transmission signal amplified in the amplifier 14*a*, the Rotman lens 15 induces or produces high frequency waves, having the same amplitude and phase corresponding to the amplitude and phase of the first transmission signal, at the beam port BP1 due to magnetic coupling between the beam port BP1 and a feeding line of the amplifier 14*a*, and distributes electric power of the high frequency waves to the antenna ports AP through the wave-guiding channels having different lengths. Therefore, the lens 15 forms high frequency waves having first phase differences at the respective antenna ports AP. In response to the high frequency waves of the antenna ports AP, the array antenna 16 produces radiation signals at the respective antenna elements due to magnetic coupling between each antenna port and the corresponding antenna element, and forms a first beam of electromagnetic waves from the radiation signals.

The waves of the first beam have the first phase differences on the antenna surface AN1 of the antenna 16 and have electric power corresponding to electric power of the high frequency waves, but the waves have the same phase along the first direction inclined with respect to the antenna surface AN1. Therefore, the antenna 16 can radiate the first beam in the first direction (or first angle to the antenna surface AN1) in response to the first amplified transmission signal.

In the same manner, in response to the second transmission signal amplified in the amplifier 14*b*, the Rotman lens 15 induces or produces high frequency waves, having the same amplitude and phase corresponding to the amplitude and phase of the second transmission signal, at the beam port BP2, and distributes electric power of the high frequency waves to the antenna ports AP to form high frequency waves having second phases differences at the respective antenna ports AP. In response to the high frequency waves of the antenna ports AP, the array antenna 16 forms a second beam of electromagnetic waves.

The waves of the second beam have the second phase differences on the antenna surface AN1 of the antenna 16 and have electric power corresponding to electric power of the high frequency waves, but the waves have the same phase along the second direction inclined with respect to the antenna surface AN1. Therefore, the antenna 16 can radiate the second beam in the second direction (or second angle to the antenna surface AN1) in response to the second amplified transmission signal.

In case of the reception of the first and second transmission signals having the same phase in the Rotman lens 15, the lens 15 combines the high frequency waves produced from the first transmission signal with the high frequency waves produced from the second transmission signal at each antenna port AP. In response to the high frequency waves combined in the antenna elements, the array antenna 16 forms a particular beam on the antenna surface AN1 and radiates this beam from the antenna surface AN1 in a particular direction (or particular angle to the antenna surface ANT). The particular beam has a first portion of electromagnetic waves and a second portion of electromagnetic waves. The first portion of waves has the first phase differences on the antenna surface AN1 and electric power corresponding to electric power of the high frequency waves produced from the first transmission signal. The second portion of waves has the second phase differences on the antenna surface AN1 and electric power corresponding to electric power of the high frequency waves produced from the second transmission signal.

Figure 3:
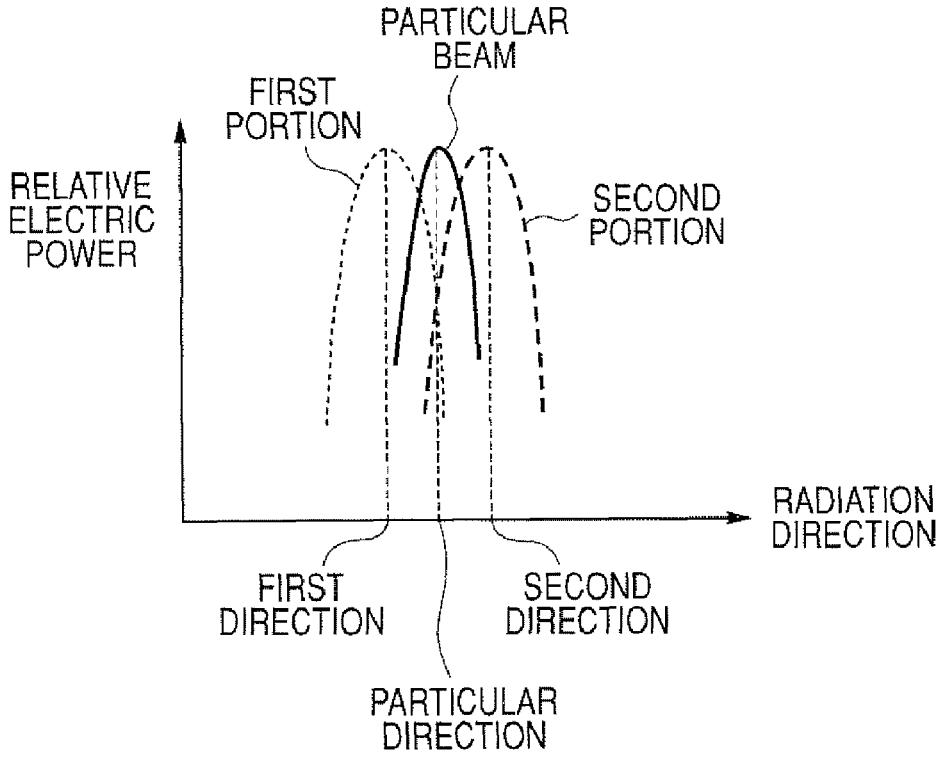
FIG. 3 is a view showing a radiation pattern of a beam obtained by combining two portions of waves with each other.

FIG. 3 is a view showing a radiation pattern of a beam obtained by combining the first and second portions of waves with each other. As shown in FIG. 3, each of the first portion of waves (i.e., first beam) and the second portion of waves (i.e., second beam) has a radiation pattern of electric power with respect to the radiation direction. The first portion of waves has the highest electric power in the first direction, and the second portion of waves has the highest electric power in the second direction. The particular beam obtained by combining the first and second portions of waves with each other has the highest electric power in the particular direction placed between the first and second directions. Therefore, the particular beam is radiated in the particular direction between the first and second directions. This particular direction depends on the power ratio of the first portion to the second portion.

The electric power of the first portion of waves depends on the electric power of the first amplified transmission signal, and the electric power of the second portion of waves depends on the electric power of the second amplified transmission signal. Therefore, the particular direction is defined by the first phase differences corresponding to the first direction, the second phase differences corresponding to the second direction, and the electric power ratio (or amplitude ratio) of the first amplified transmission signal to the second amplified transmission signal (i.e., ratio of the first amplification factor to the second amplification factor).

The receiving block 20 has a beam receiving unit 81 for receiving a beam, which is radiated from the block 10 and is reflected from an object, from the particular direction, and producing a first composite signal and a second composite signal from the received beam, a composite signal adjusting unit 23 for appropriately amplifying the composite signals, a power combiner (or reception signal producing unit) 24 for combining the composite signals amplified in the adjusting unit 23 to produce a reception signal indicating information about the object, and a mixer 25 for mixing the reception signal with the local signal of the first divider 12 of the transmitting block 10 to produce a beat signal.

The receiving unit 81 has a reception array antenna 21 and a Rotman lens 22 denoting a passive element acting as a lens. The array antenna 21 has a plurality of antenna elements (e.g., four antenna elements), respectively, receiving electromagnetic waves of the beam. These antenna elements are aligned on an antenna surface AN2 at equal intervals. The Rotman lens 22 has two reception beam ports BP (BP3 and BP4) and a plurality of antenna ports AP (e.g., four antenna ports AP5, AP6, AP7 and AP8) connected with the antenna elements of the array antenna 21. The beam ports BP3 and BP4 (i.e., output portions) are placed on one side of the lens 22 and are spaced from each other at a predetermined interval. The antenna ports AP5 to AP8 (i.e., input portion) are placed on the other side of the lens 22 and are spaced from one another at predetermined intervals. Each beam port BP is spaced from the antenna ports AP through wave-guiding channels of the lens 22 at different intervals.

The array antenna 21 receives a beam coming from the particular direction (or particular angle to the antenna surface AN2). This beam has a first portion of electromagnetic waves having first phase differences on the antenna surface AN2 and a second portion of electromagnetic waves having second phase differences on the antenna surface AN2. The first phase differences correspond to the first direction. The second phase differences correspond to the second direction. In response to the first portion of waves contained in the beam, the Rotman lens 22 induces or produces first high frequency waves having the first phase differences and electric power corresponding to the first portion of waves at the antenna ports AP. Further, in response to the second portion of waves contained in the beam, the Rotman lens 22 induces or produces second high frequency waves having the second phase differences and electric power corresponding to the second portion of waves at the antenna ports AP. The Rotman lens 22 transmits the first high frequency waves of the antenna ports AP to the beam port BP3 so as to produce the first high frequency waves having the same phase at the beam port BP3, and produces a first composite signal at the beam port BP3. Therefore, the first composite signal has the same phase as that of the first high frequency waves and has electric power of the first high frequency waves, so that electric power and phase of the first composite signal corresponds to electric power and phase of the first portion of waves. In the same manner, the Rotman lens 22 transmits the second high frequency waves of the antenna ports AP to the beam port BP4 to produce the second high frequency waves having the same phase at the beam port BP4, and produces a second composite signal at the beam port BP4. Therefore, the second composite signal has the same phase as that of the second high frequency waves and has electric power of the second high frequency waves, so that electric power and phase of the second composite signal corresponds to electric power and phase of the second portion of waves.

The amplitude ratio of the first portion of waves to the second portion of waves corresponds to the particular direction of the received beam, so that the amplitude ratio of the first composite signal to the second composite signal indicates the particular direction of the received beam. Because the received beam is produced from the transmission signals having the same phase in the transmitting block 10, the composite signals have the same phase.

The adjusting unit 23 has a first variable amplifier 23*a* connected with the beam port BP3 and a second variable amplifier 23*b* connected with the beam port BP4. The amplifier 23*a* sets a third variable amplification factor (i.e., a third gain) according to a first reception control signal of the controller 30 and amplifies the first composite signal by the third variable amplification factor. The amplifier 23*b* sets a fourth variable amplification factor (i.e., a fourth gain) according to a second reception control signal of the controller 30 and amplifies the second composite signal by the fourth variable amplification factor.

The combiner 24 has the same structure as that of the second divider 13 shown in FIG. 2. The combiner 24 receives the amplified composite signals at the respective separated terminals, produces a reception signal by combining the composite signals with each other at the common terminal and outputs the reception signal from the common terminal. Two transmission lines, respectively, connecting the separated terminals of the combiner 24 and the amplifiers 23*a* and 23*b* have the same length. Therefore, the composite signals received in the amplifiers 23*a* and 23*b* have the same phase.

The controller 30 has a temperature sensor 31 for detecting the ambient temperature of the radar apparatus 1, a map storing unit 32 for storing a transmission adjusting map, a reception adjusting map, a transmission correcting map and a reception correcting map, and an adjustment setting unit 33. The transmission adjusting map indicates the relationship between the direction of the beam radiated from the transmitting block 10 and a transmission adjustment denoting gains of the amplifiers 14*a* and 14*b*. The reception adjusting map indicates the relationship between the direction of the beam received in the receiving block 20 and a reception adjustment denoting gains of the amplifiers 23*a* and 23*b*. The transmission correcting map indicates the relationship between the ambient temperature and a correction of the transmission adjustment. The reception correcting map indicates the relationship between the ambient temperature and a correction of the reception adjustment. The adjustment setting unit 33 sets adjusting instructions indicating gains of the amplifiers 14*a*, 14*b*, 23*a* and 23*b* according to the instruction of the unit 40, the ambient temperature detected in the sensor 31 and the maps of the unit 32, outputs the adjusting instructions to the respective amplifiers 14*a* and 14*b* of the block 10 and outputs the other adjusting instructions to the respective amplifiers 23*a* and 23*b* of the block 20.

Therefore, the amplifiers 14*a* and 14*b* amplify the transmission signals according to the adjusting instructions, and the amplifiers 23*a* and 23*b* appropriately amplify the composite signals according to the adjusting instructions. For example, the controller 30 controls the amplifiers 14*a* and 14*b* such that the summed electric power of the amplified transmission signals becomes a constant value.

To radiate a particular beam in the particular direction, it is required that the amplitude ratio of the first transmission signal amplified in the amplifier 14*a* to the second transmission signal amplified in the amplifier 14*b* is set at a particular value. The transmission adjusting map is produced by experimentally determining the ratio required to radiate a beam in each of many directions. In the same manner, to appropriately amplify the composite signals in the amplifiers 23*a* and 23*b*, the reception adjusting map is produced by experimentally determining the amplitude ratio of the first composite signal amplified in the amplifier 23*a* to the second composite signal amplified in the amplifier 23*b*.

For example, the first and second variable amplification factors are set based on the transmission adjusting map in the amplifiers 14*a* and 14*b* such that the ratio of electric power outputted from the amplifier 14*a* to electric power outputted from the amplifier 14*b* is set at 1:0, 0.9:0.1, 0.81:0.19, 0.5:0.5 and 0:1 in that order every scanning period.

Figure 4A:
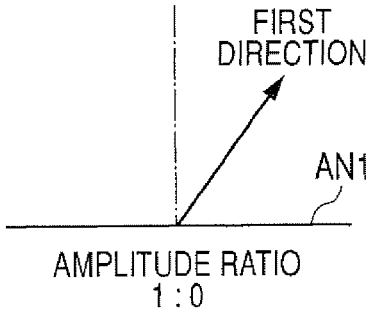
FIG. 4A is a view showing a beam radiated in a first direction in case of the amplitude ratio 1:0.
Figure 4B:
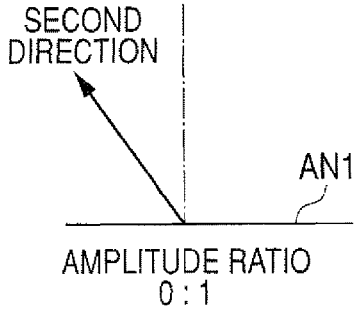
FIG. 4B is a view showing a beam radiated in a second direction in case of the amplitude ratio 0:1.
Figure 4C:
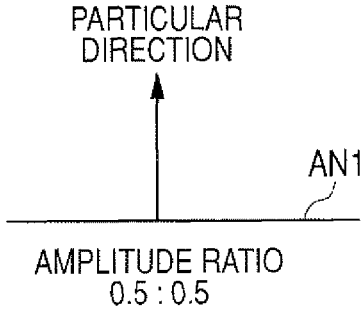
FIG. 4C is a view showing a beam radiated in a middle direction between the first and second directions in case of the amplitude ratio 0.5:0.5.

FIG. 4A is a view showing the beam radiated in the first direction in case of the amplitude ratio 1:0, FIG. 4B is a view showing the beam radiated in the second direction in case of the amplitude ratio 0:1, and FIG. 4C is a view showing the beam radiated in the middle direction between the first and second directions in case of the amplitude ratio 0.5:0.5.

For example, as shown in FIG. 4A, when the amplitude ratio in the adjusting unit 14 is set at 1:0, the array antenna 16 radiates the beam in the first direction. As shown in FIG. 4B, when the amplitude ratio is set at 0:1, the array antenna 16 radiates the beam in the second direction. When the amplitude ratio differs from 1:0 and 0:1, the particular direction of the beam differs from the first and second directions. As shown in FIG. 4C, when the amplitude ratio is set at 0.5:0.5, the particular direction of the beam accords with the middle direction between the first and second directions.

Each of the Rotman lenses 15 and 22 has characteristics that change with temperature. For example, the distance between the beam ports BP1 (or BP3) and BP2 (or BP4) is changed with temperature. Therefore, the controller 30 corrects the adjustments of the adjusting maps on the basis of the ambient temperature to compensate differences between actual characteristics of the Rotman lens 15 and designed characteristics of the Rotman lens 15 and to compensate differences between actual characteristics of the Rotman lens 22 and designed characteristics of the Rotman lens 22. In this embodiment, for example, a correction value or a correction factor is determined as the correction of the transmission adjustment from the ambient temperature detected in the sensor 31, and the transmission adjustment determined based on the direction of the transmitting beam is corrected by adding the correction value to the adjustment or by multiplying the adjustment by the correction factor.

The object information detecting unit 40 is structured by a well-known microcomputer having a central processing unit (CPU) including a digital signal processor (DSP), a read only memory (ROM) for storing programs used for information detection, a random access memory (RAM) and an analog-to-digital (A/D) converter. The unit 40 supplies a beam instruction to the unit 33 of the controller 30. This instruction specifies a beam radiation direction changing with time within a predetermined range. The unit 40 supplies a transmission instruction to the VCO 11 of the block 10 as the transmission signal. This instruction indicates a beam transmission period of time. The unit 40 detects beat frequencies of the beat signal outputted from the mixer 25 in the A/D converter every sampling period of time to obtain sampling data. These sampling data are stored in the RAM, and the DSP performs fast Fourier transform (FFT) on the sampling data.

The operation of the radar apparatus I will be described.

When the unit 40 sends a transmission instruction to the transmitting block 11 while sending a beam instruction to the unit 33 of the controller 30, a frequency-modulated high frequency signal is intermittently generated in the VCO 11 every radiation period of time. As is well known, a triangular wave modulation is performed for a carrier wave of the frequency F0 at a frequency modulation width $\Delta F$ by using a controlled voltage outputted from a direct current source (not shown) for modulation. Therefore, the modulated wave having the variable frequency in the range of $F0 \pm \Delta F$ (i.e., variable wavelength in the range of $\lambda \pm \Delta\lambda$) is produced as the high frequency signal. A local signal is produced from this signal in the divider 12 and is outputted to the mixer 25 of the receiving block 20. First and second transmission signals are produced from the high frequency signal in the divider 13, and these transmission signals having the same amplitude and phase are received in the amplifiers 14*a* and 14*b* of the adjusting unit 14.

In this case, even when a part of electric power of the first transmission signal is returned from the amplifier 14*a* to the divider 13, the resistive element 133 of the divider 13 substantially prevents the returned power from being transmitted to the amplifier 14*b*. More specifically, as shown in FIG. 2, a first returned signal is transmitted from the amplifier 14*a* to the amplifier 14*b* through the transmission lines 131 and 132, and a second returned signal is transmitted from the amplifier 14*a* to the amplifier 14*b* through the resistive element 133. The phases of the returned signals are differentiated from each other by a half of the wavelength $\lambda$ at the amplifier 14*b*.

Therefore, the returned signals are substantially cancelled out so as to supply no electric power of the signals to the amplifier 14*b*. The power of the returned signals are consumed in the resistive element 133. In the same manner, even when a part of electric power of the second transmission signal is returned from the amplifier 14*b* to the divider 13, the resistive element 133 of the divider 13 substantially prevents the returned power from being transmitted to the amplifier 14*a*. Accordingly, the divider 13 with the element 133 can enhance the isolation between the amplifiers 14*a* and 14*b*, and the combiner 24 with the element 133 can enhance the isolation between the amplifiers 23*a* and 23*b*.

In the controller 30, in response to the beam instruction, adjusting instructions are sent from the setting unit 33 to the respective amplifiers 14*a* and 14*b*, and the transmission signals are, respectively, amplified according to the adjusting instructions in the amplifiers 14*a* and 14*b*. In this amplification, the amplitude ratio of the first transmission signal amplified in the amplifier 14*a* to the second transmission signal amplified in the amplifier 14*b* is changed with time in a predetermined ratio range every scanning period of time much longer than the radiation period.

The amplified transmission signals having the same phase are received in the beam ports BP1 and BP2 of the Rotman lens 15. In the Rotman lens 15, first high frequency waves having first phase differences are produced from the first amplified transmission signal at the antenna ports AP, second high frequency waves having second phase differences are produced from the second amplified transmission signal at the antenna ports AP, and the first and second high frequency waves are combined with each other at each antenna port AP. In the array antenna 16, a particular beam of electromagnetic waves is formed from the combined high frequency waves of the antenna ports AP.

This particular beam is composed of the first portion of electromagnetic waves, having first phase differences on the antenna surface AN1 and having electric power corresponding to electric power of the first amplified transmission signal, and the second portion of electromagnetic waves, having second phase differences on the antenna surface AN1 and having electric power corresponding to electric power of the second amplified transmission signal. In other words, the first portion of electromagnetic waves has propagation directions centered on the first direction corresponding to the first phase differences, and the second portion of waves has propagation directions centered on the second direction corresponding to the second phase differences. Therefore, the particular beam is radiated in the particular direction placed between the first and second radiation directions. Because the amplitude ratio in the adjusting unit 14 is changed with time, the radiation direction of the beam is also changed with time. Therefore, the radar apparatus 1 performs the beam scanning.

When the beam radiated in the particular direction from the array antenna 16 is reflected by an object and is returned to the antenna device 60, the array antenna 21 receives electromagnetic waves of a beam coming from the particular direction at the respective antenna elements. In response to the reception of the beam in the antenna 21, the Rotman lens 22 produces a first composite signal at the beam port 23*a* and a second composite signal at the beam port 23*b*.

The amplitude ratio of the first composite signal to the second composite signal depends on the coming direction of the received beam. For example, when the received beam comes from the first direction, the amplitude ratio becomes 1:0. When the receiving beam comes from the second direction, the amplitude ratio becomes 0:1. When the amplitude ratio differs from 1:0 and 0:1, the coming direction of the receiving beam differs from the first and second directions.

Further, in response to the beam instruction of the detecting unit 40, adjusting instructions indicating amplification factors are sent from the setting unit 33 to the respective amplifiers 23*a* and 23*b*, and the composite signals are, respectively, amplified in the amplifiers 23*a* and 23*b* according to the adjusting instructions. Because the direction of the beam radiated from the block 10 is specified by the detecting unit 40, the amplification ratio in the composite signals are known by the unit 40, and the composite signals are, for example, amplified under control of the unit 40 to have the same amplitude or to have electric power higher than a threshold value. In this case, information of the object can be adequately detected in the unit 40.

Then, the composite signals are combined in the combiner 24 to produce a reception signal having information of the object, and the reception signal is mixed with the local signal of the divider 12 in the mixer 25 to produce a beat signal. The detecting unit 40 detects the speed of the apparatus 1 relative to the object and the distance between the apparatus 1 and the object from the beat signal in addition to the particular bearing angle to the object corresponding to the particular direction.

As described above, because the amplitude ratio in the transmission signals are changeably set in the amplifiers 14*a* and 14*b* under control of the controller 30, the direction of the beam radiated from the transmitting block 10 can be changeably adjusted in the Rotman lens 15. Further, because amplitudes of the composite signals formed from the received beam are appropriately set in the amplifiers 23*a* and 23*b* under control of the controller 30, the receiving block 20 can adjust the reception signal such that the unit 40 appropriately detects information about the object from the reception signal.

Therefore, when the beam radiated from the array antenna 16 in the particular direction specified by the unit 40 is reflected by the object, the detecting unit 40 can obtain the bearing angle to the object corresponding to the particular direction, the speed of the apparatus 1 relative to the object and the distance between the apparatus 1 and the object.

Accordingly, because the antenna device 60 has the Rotman lens 15 having only two beam ports BP1 and BP2 and two amplifiers 14*a* and 14*b* connected with the beam ports in the transmitting block 10, the antenna device 60 using a passive element having the same function as the function of a lens can be manufactured in a simple structure without using any high frequency switch, and the antenna device 60 can be freely set to form a beam radiated in any direction between the first and second directions.

Further, the antenna device 60 has the Rotman lens 22 having only two beam ports BP3 and BP4 and two amplifiers 23*a* and 23*b* connected with the beam ports in the receiving block 20. Accordingly, the antenna device 60 using a passive element having the same function as the function of a lens can be manufactured in a simple structure to appropriately receive a beam coming from any direction between the first and second directions and to appropriately detect information about the object in the unit 40 from the received beam.

Moreover, the amplification in each of the amplifiers 14*a*, 14*b*, 23*a* and 23*b* is adjusted according to the ambient temperature of the radar apparatus 1. Accordingly, the antenna device 60 can set the radiation direction of the transmitting beam with high precision, and the antenna device 60 can detect the incoming direction of the received beam with high precision so as to heighten the precision in the detection of the bearing angle to the object.

In this embodiment, when the radar apparatus 1 is, for example, mounted on a vehicle, the radar apparatus 1 may change the radiation direction of the transmitting beam in any of the horizontal and vertical planes. To change the radiation direction of the beam in the horizontal plane, the antenna elements of the array antenna 16 are aligned along the horizontal direction, and the antenna elements of the array antenna 21 are also aligned along the horizontal direction. In contrast, when the radar apparatus 1 vertically changes the radiation direction of the beam, the antenna elements of the array antenna 16 are aligned along the vertical direction, and the antenna elements of the array antenna 21 are also aligned along the vertical direction.

When the radar apparatus 1 is fixed to the vehicle so as to align the antenna elements of the array antenna 16 along the vertical direction, the antenna surface of the antenna 16 is sometimes inclined with respect to the vertical plane. In this case, the radiation angle of the beam to the antenna surface undesirably differs from the radiation angle of the beam to the vertical plane. To avoid this problem, in the same manner as the adjusting work for the optical axis of the headlamp of the vehicle, the apparatus 1 is fixed to the vehicle by using three bolts, and the fastening force of the bolts is normally adjusted manually by hand to precisely place the antenna surface in the vertical plane. This adjusting work is troublesome. However, in this embodiment, because gains in the amplifiers can be arbitrarily adjusted, the radiation direction of the beam to the antenna surface can be easily changed without manually adjusting the bolts by hand. As a result, the radar apparatus 1 can appropriately change the radiation direction of the beam to improve the performance of the apparatus 1.

In this embodiment, each of the Rotman lenses 15 and 22 has two beam ports BP. However, each Rotman lens may have three beam ports or more. In this case, the beam ports are connected with respective amplifiers of the adjusting unit 14 or 23.

Figure 5:
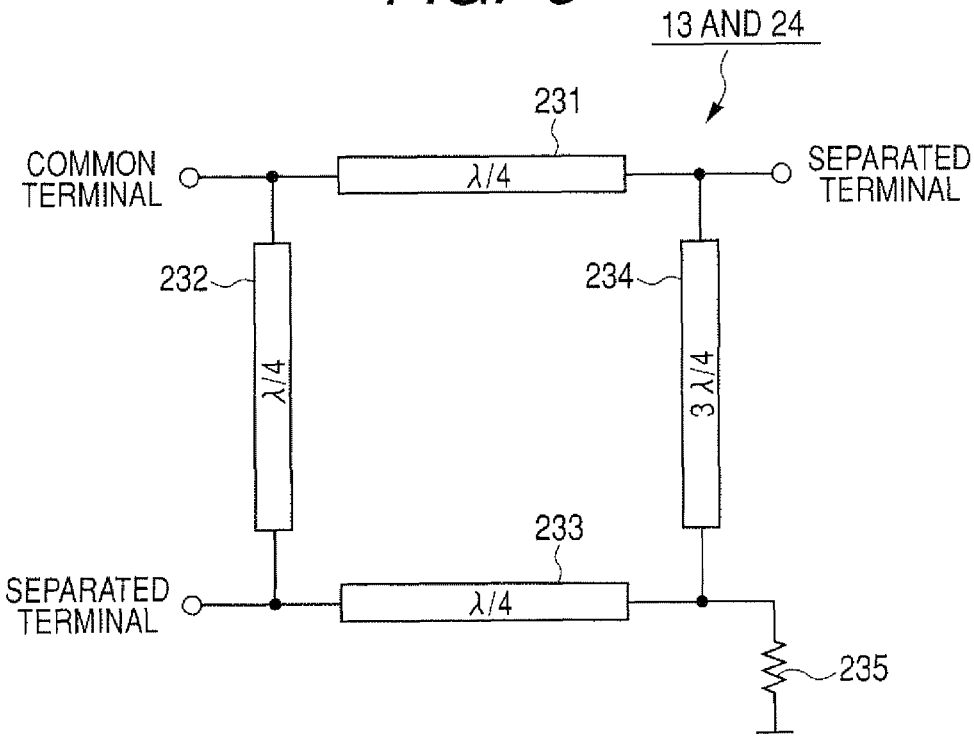
FIG. 5 is a view showing the structure of a Rat-Race divider according to a modification of the first embodiment.

Further, a Wilkinson power divider or combiner shown in FIG. 2 is used as each of the divider 13 and the combiner 24. However, a Rat-Race power divider or combiner shown in FIG. 5 may be used as each of the divider 13 and the combiner 24. As shown in FIG. 5, the Rat-Race power divider or combiner has four transmission lines 231, 232, 233 and 234 and a resistive element 235. The transmission line 231 is placed between the common terminal and the first separated terminal, and the transmission line 232 is placed between the common terminal and the second separated terminal. The transmission line 233 is placed between the second separated terminal and one end of the element 235, and the transmission line 234 is placed between the first separated terminal and the end of the element 235. The other end of the element 235 is earthed. The transmission lines 231 to 233 have the same length of $\lambda/4$, and the transmission line 234 has the length of $3\lambda/4$. Therefore, the first and second transmission signals transmitted to the adjusting unit 14 have the same amplitude and phase. Further, the length of the first route between the separated terminals through the transmission lines 231 and 232 differs from the length of the second route through the transmission lines 233 and 234 by a half of the wavelength $\lambda$. Therefore, even when a part of electric power of the first transmission signal is returned from the amplifier 14*a* (or 14*b*) to the divider 13, the resistive element 235 of the divider 13 substantially prevents the returned power from being transmitted to the amplifier 14*b* (or 14*a*).

Moreover, the transmission signals received in the amplifiers 14*a* and 14*b* have the same amplitude and the same phase. However, the transmission signals received in the amplifiers 14*a* and 14*b* may have different amplitudes or different phases. In this case, it is required to perform the calibration in the unit 14 for the purpose of compensating different amplitudes or different phases of the signals.

Furthermore, the amplification factors in the unit 14 are set such that the summed electric power of the amplified transmission signals becomes a constant value. Accordingly, the transmission power of the radar beam becomes constant, and the radar beam can be radiated according to relevant laws and regulations.

Still further, each of the adjusting units 14 and 23 has variable amplifiers. However, the adjusting unit 14 or 23 may have phase shifters in place of the amplifiers or may have phase shifters in addition to the amplifiers.

Figure 6:
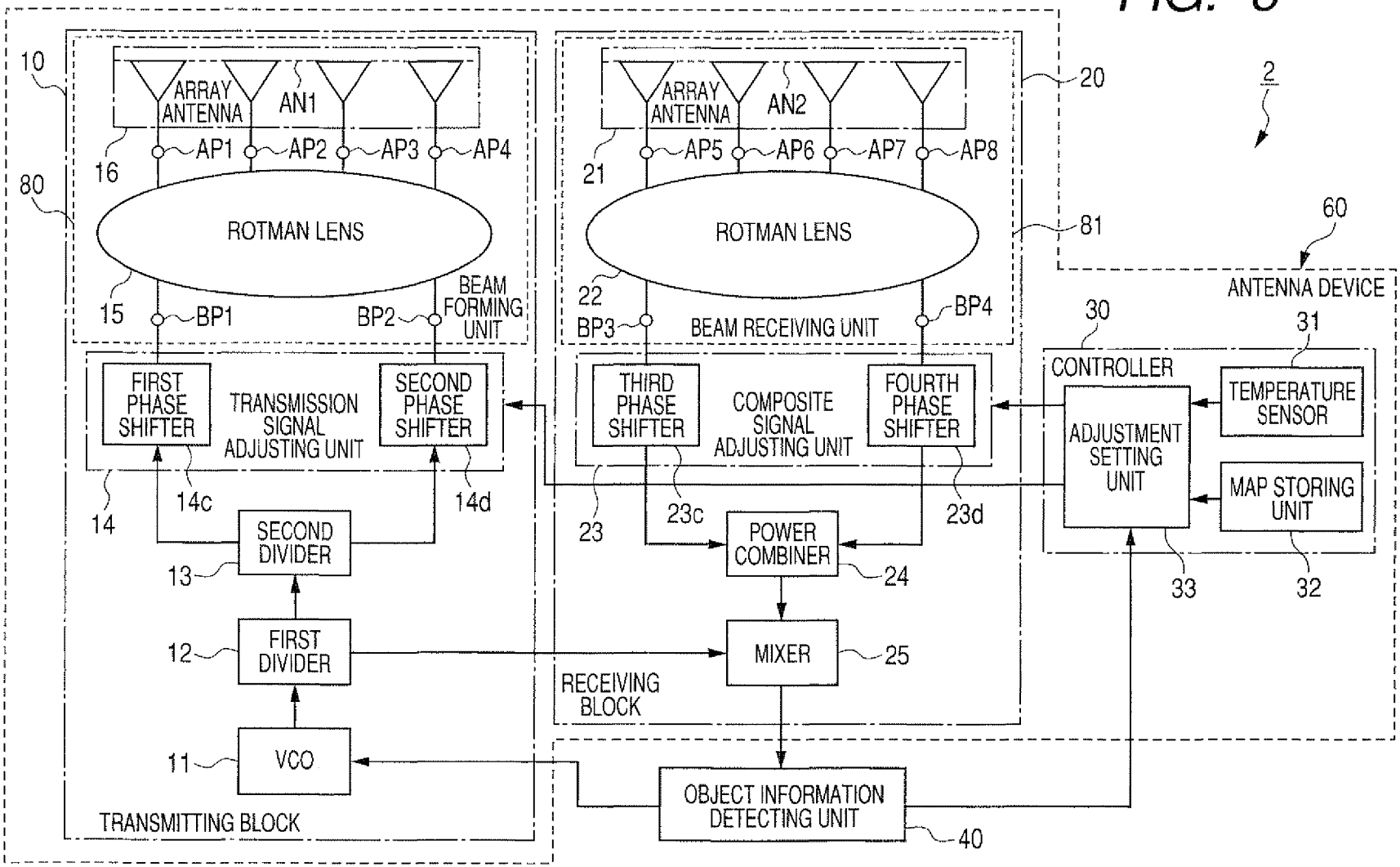
FIG. 6 is a block diagram of a radar apparatus having an antenna device according to another modification of the first embodiment.

FIG. 6 is a block diagram of a radar apparatus having an antenna device according to a first modification of the first embodiment. As shown in FIG. 6, the radar apparatus 2 differs from the radar apparatus 1 shown in FIG. 1 in that the adjusting unit 14 has two phase shifters 14*c* and 14*d* in place of the amplifiers while the adjusting unit 23 has two phase shifters 23*c* and 23*d* in place of the amplifiers.

With this structure, the phase shifters 14*c* and 14*d* of the transmitting block 10 shift phases of the transmission signals to set the phase difference between the signals. Therefore, the array antenna 16 radiates a beam in a particular direction different from the first and second directions. This particular direction is placed outside the directional range between the first and second directions by appropriately setting the phase difference between the signals.

Further, when the array antenna 21 of the receiving block 20 receives a beam radiated from the block 10 and reflected by an object, composite signals received in the phase shifters 23*c* and 23*d* have different phases corresponding to those set in the adjusting unit 14. Because the phases of the composite signals are known by the controller 30, the phases of the composite signals are shifted in the phase shifters 23*c* and 23*d* so as to have the same phase. Therefore, the reception signal produced in the combiner 24 appropriately has information about the object. In this case, the detecting unit 40 can appropriately detect this information.

Accordingly, because the adjusting units 14 and 23 adjust phases of the received signals, the antenna device 60 can radiate a beam in a particular direction between the first and second directions and can radiate a beam in a particular direction placed outside the directional range between the first and second directions.

Further, the antenna device 60 can appropriately produce the reception signal indicating information about the object by receiving a beam radiated from the apparatus 60 and reflected by the object.

Second Embodiment

Figure 7:
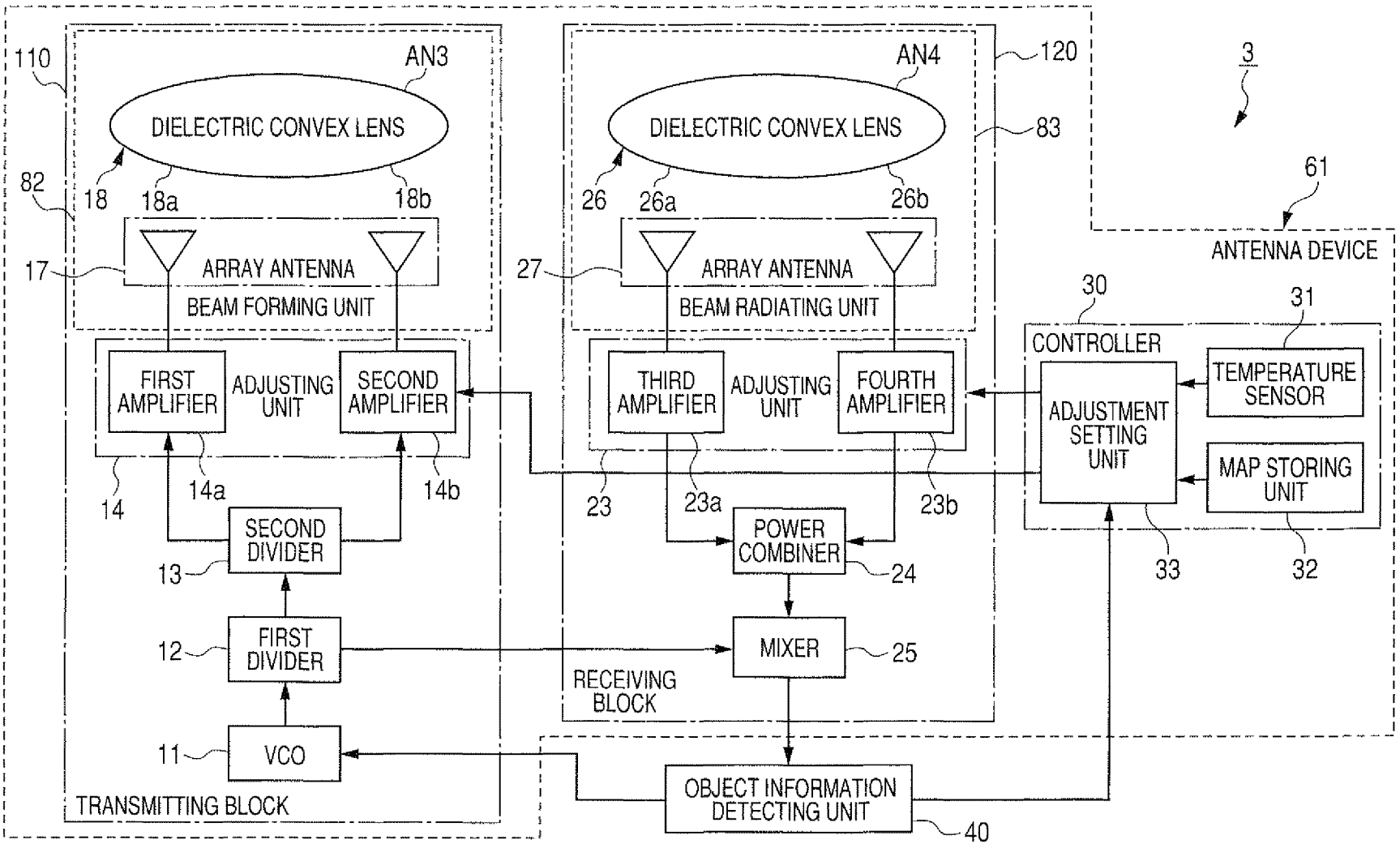
FIG. 7 is a block diagram of a radar apparatus having an antenna device according to the second embodiment of the present invention.

FIG. 7 is a block diagram of a radar apparatus having an antenna device according to the second embodiment. As shown in FIG. 7, a radar apparatus 3 differs from the radar apparatus 1 according to the first embodiment in that an antenna device 61 of the radar apparatus 3 has a beam forming unit 82 of a transmitting block 110 in place of the unit 80 and has a beam receiving unit 83 of a receiving block 120 in place of the unit 81.

The forming unit 82 has a transmission array antenna 17 and a dielectric convex lens 18. The antenna 17 has two antenna elements connected with the respective amplifiers 14*a* and 14*b*. The lens 18 has a first input surface (i.e., first input portion) 1*a*, a second input surface (i.e., second input portion) lab and an antenna surface AN3 acting as an output portion of the unit 82. The antenna elements of the antenna 17 are disposed to be symmetric to each other with respect to the optical axis (i.e., center axis) of the lens 18. These antenna elements face the respective input surfaces of the lens 18 along the optical axis.

The forming unit 83 of the receiving block 120 has a dielectric convex lens 26 and a transmission array antenna 27 having two antenna elements connected with the respective amplifiers 23*a* and 23*b*. The lens 26 has an antenna surface AN4 acting as an input portion, a first output surface (i.e., first output portion) 26*a* and a second output surface (i.e., second output portion) 26*b*. The antenna elements of the antenna 27 are disposed to be symmetric to each other with respect to the optical axis (i.e., center axis) of the lens 22. The antenna elements of the antenna 27, respectively, face the output surfaces of the lens 26 along the optical axis.

The map storing unit 32 of the controller 30 has the maps corresponding to the lenses 18 and 26, the positional relationship between the lens 18 and the antenna 17, and the positional relationship between the lens 26 and the antenna 27.

In response to the first transmission signal amplified in the amplifier 14*a*, one antenna element of the antenna 17 produces electromagnetic waves of a first beam having the amplitude and phase corresponding to the amplitude and phase of the signal and radiates the beam. This beam is transmitted to the first input surface of the lens 18. Then, this beam is refracted and phase shifted by the lens 18. That is, the waves of the beam have first phase differences on the antenna surface AN3 of the lens 18. Therefore, the first beam is radiated in the first direction corresponding to the first phase differences. This first direction is deflected from the optical axis of the lens 18.

In the same manner, in response to the second transmission signal amplified in the amplifier 14*b*, the other antenna element of the antenna 17 produces electromagnetic waves of a second beam having the amplitude and phase corresponding to the amplitude and phase of the second transmission signal and radiates the beam. This beam is transmitted to the second input surface of the lens 18. Then, this beam is refracted and phase-shifted by the lens 18. That is, the waves of the beam have second phase differences on the antenna surface AN3 of the lens 18. Therefore, the second beam is radiated in the second direction corresponding to the second phase differences. This second direction is inclined with respect to the optical axis of the lens 18.

When the first and second transmission signals are amplified in the amplifiers 14*a* and 14*b* at a changeable amplifier ratio, the electromagnetic waves of the first beam and the electromagnetic waves of the second beam are combined with each other on the antenna surface AN3 of the lens 18 to form a particular beam. This particular beam has propagation directions centered on the particular direction placed between the first and second directions. Therefore, the transmitting block 110 radiates the particular beam in the particular direction while changing the direction of the beam.

When a beam of electromagnetic waves coming from the first direction is received in the lens 26, these waves have first different phases on an antenna surface AN4 of the lens 26. This beam is refracted by the lens 26 while phases of waves are shifted, and the waves have the same phase on the first output surface of the lens 26. In other words, the reception strength of the waves is maximized on the first output surface. Then, the beam is outputted from the lens 26. The antenna element of the antenna 27 connected with the amplifier 23*a* receives this beam and produces a first reception signal from the beam. Therefore, information about the object can be detected from the reception signal at the bearing angle to the object corresponding to the first direction.

In the same manner, when a beam of electromagnetic waves coming from the second direction is received in the lens 26, these waves have second different phases on the antenna surface AN4 of the lens 26. This beam is refracted by the lens 26 while phases of waves are shifted, and the waves have the same phase on the second output surface of the lens 26. Then, the beam is outputted from the lens 26. The antenna element of the antenna 27 connected with the amplifier 23*b* receives this beam and produces a second reception signal from the beam. Therefore, information about the object can be detected from the reception signal at the bearing angle to the object corresponding to the second direction.

When a beam of electromagnetic waves having propagation directions centered on the particular direction between the first and second directions is received in the lens 26, a first portion of these waves forming a first beam have first different phases on the antenna surface AN4 of the lens 26, and a second portion of these waves forming a second beam have second different phases on the antenna surface AN4 of the lens 26. The first beam is refracted by the lens 26, and the waves of this beam have the same phase on the first output surface of the lens 26 and are received in the antenna element of the antenna 27 connected with the amplifier 23*a*. Then, a first reception signal is produced from the waves having the same phase and is amplified in the amplifier 23*a*. The second beam is refracted by the lens 26, and the waves of the second beam have the same phase on the second output surface of the lens 26 and are received in the antenna element of the antenna 27 connected with the amplifier 23*b*. Then, a second reception signal is produced from the waves of the second beam having the same phase and is amplified in the amplifier 23*b*. Therefore, information regarding the object can be obtained from the reception signals at the bearing angle to the object corresponding to the particular direction.

Accordingly, because the forming unit 82 of the block 110 has only two antenna elements to radiate a beam in the particular direction, the antenna device 61 using the dielectric lens 18 can radiate a beam in any direction between the first and second directions in a simple structure.

Further, because the receiving unit 83 of the block 120 has only two antenna elements to receive a beam coming from the particular direction, the antenna device 61 using the dielectric lens 26 can appropriately receive a beam coming from any direction between the first and second directions in a simple structure to obtain information about the object from the received beam.

Moreover, in the same manner as in the first embodiment, the antenna device 61 can control the radiation direction of the beam with high precision and can detect the bearing angle to the object with high precision.

In this embodiment, each of the array antennas 17 and 27 has two antenna elements. However, each array antenna may have three antenna elements or more. In this case, the antenna elements are connected with respective amplifiers of the adjusting unit 14 or 23.

Figure 8:
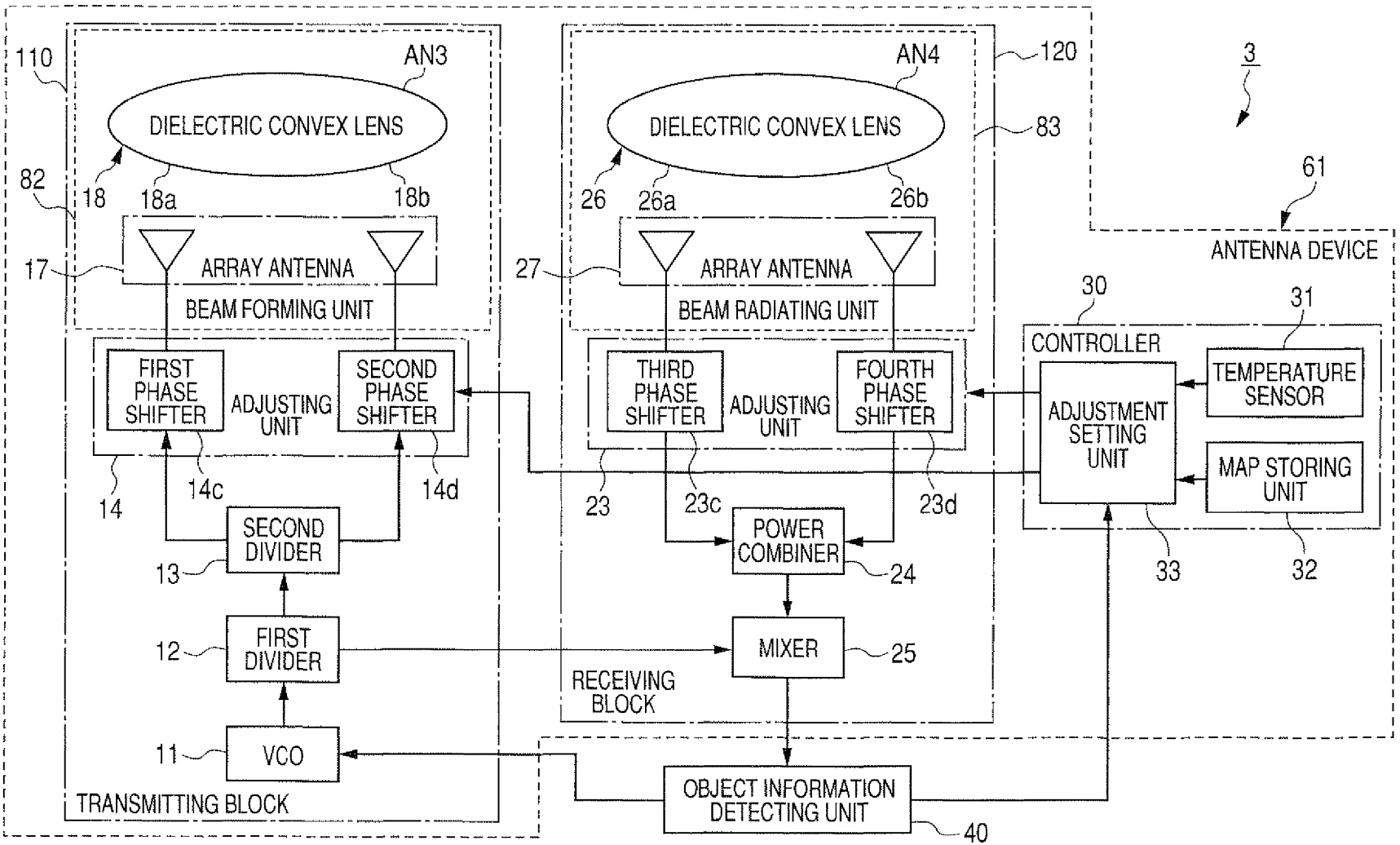
FIG. 8 is a block diagram of a radar apparatus having an antenna device according to another modification of the second embodiment.

Further, as shown in FIG. 8, the antenna device may have the phase shifters 14*c* and 14*d* and the phase shifters 23*c* and 23*d* shown in FIG. 6 in place of the amplifiers 14*a*, 14*b*, 23*a* and 23*b*. In this case, in the same manner as in the antenna device shown in FIG. 6, the antenna device can radiate a beam in any direction different from the first and second directions with high precision and can receive a beam coming from any direction different from the first and second directions with high precision.

Third Embodiment

Figure 9:
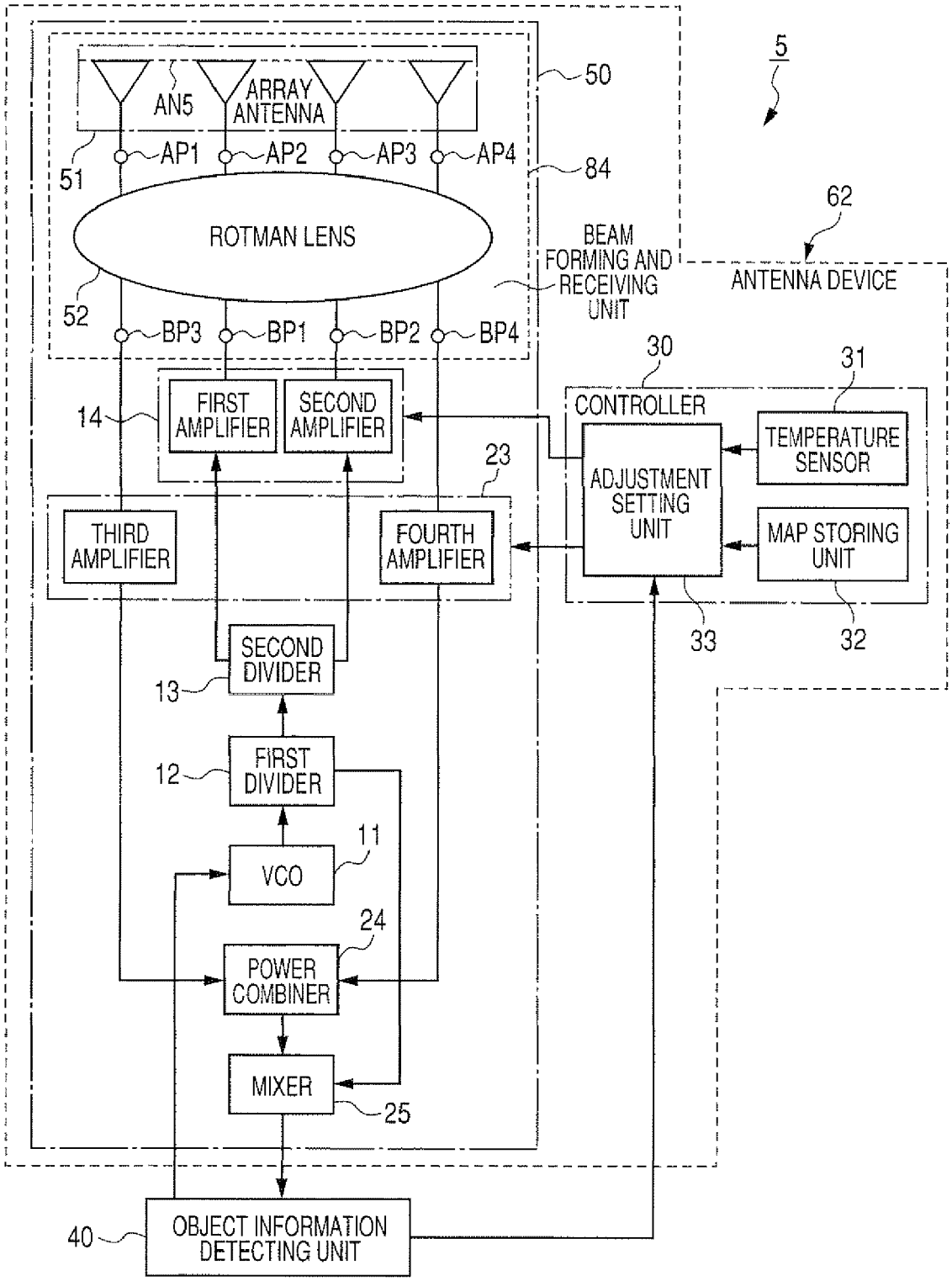
FIG. 9 is a block diagram of a radar apparatus having an antenna device according to the third embodiment.

FIG. 9 is a block diagram of a radar apparatus having an antenna device according to the third embodiment. As shown in FIG. 9, a radar apparatus 5 differs from the radar apparatus 1 according to the first embodiment in that an antenna device 62 of the radar apparatus 5 has a transmitting and receiving block 50 in place of the blocks 10 and 20. The block 50 has the VCO 11, the dividers 12 and 13, the adjusting unit 14, a beam forming and receiving unit 84, the adjusting unit 23, the combiner 24 and the mixer 25.

The unit 84 has a Rotman lens 52 and an array antenna 51. The lens 52 has two transmission beam ports BP (BP1 and BP2), a plurality of antenna ports AP (e.g., four antenna ports AP1, AP2, AP3 and AP4) and two reception beam ports BP (BP3 and BP4). The lens 52 is a passive element acting as a lens. The beam ports BP1 and BP2 (i.e., input portions) are placed on the first side of the lens 52 and are spaced from each other at a predetermined interval. The beam ports BP1 and BP2 are connected with the respective amplifiers 14*a* and 14*b* of the unit 14. The beam ports BP3 and BP4 (i.e., reception portions) are placed on the first side of the lens 52 and are spaced from each other at another predetermined interval. The beam ports BP3 and BP4 are connected with the respective amplifiers 23*a* and 23*b* of the unit 23. The antenna ports AP (i.e., output portion) are placed on the second side of the lens 52 and are spaced from one another at predetermined intervals. Each beam port BP is spaced from the antenna ports AP through wave-guiding channels of the lens 52 at different intervals. The array antenna 51 has a plurality of antenna elements, (e.g., four antenna elements) connected with the respective antenna ports AP. The antenna elements are aligned on an antenna surface AN5 at equal intervals.

The map storing unit 32 of the controller 30 has the maps corresponding to the Rotman lens 52.

With this structure of the antenna device 62, in the same manner as in the first embodiment, the unit 84 radiates a particular beam of electromagnetic waves produced from the transmission signals in the particular direction.

When an object reflects the particular beam to the antenna device 62 as an incoming beam, the antenna 51 receives this incoming beam coming from the particular direction. This beam is composed of electromagnetic waves of a third beam having propagation directions centered on a third direction and electromagnetic waves of a fourth beam having propagation directions centered on a fourth direction different from the third direction.

In response to this reception, the lens 52 produces third high frequency waves having third phase differences and fourth high frequency waves having fourth phase differences at the output ports AP, transmits the third high frequency waves to the beam port BP3 so as to give the same phase to the third high frequency waves at the beam port BP3, and transmits the fourth high frequency waves to the beam port BP4 so as to give the same phase to the fourth high frequency waves at the beam port BP4. The lens 52 produces a first composite signal from the third high frequency waves having the same phase at the beam port BP3, and produces a second composite signal from the fourth high frequency waves having the same phase at the beam port BP4.

Accordingly, the same effects as those in the first embodiment can be obtained. Further, because only one Rotman lens 52 is used for the antenna device 62, the structure of the antenna device 62 can be further simplified.

In this embodiment, the antenna device may be structured according to the conception of the second embodiment. That is, in place of the unit 84, the antenna device may have a dielectric convex lens, the array antenna 17 (see FIG. 7) disposed to face the first side of the lens, and the array antenna 27 (see FIG. 7) disposed to face the first side of the lens.

In the first to third embodiments, the beam is received through the Rotman lens or the dielectric lens to detect information about the object with high precision. However, the beam may be received without using the Rotman lens or the dielectric lens.

Figure 10:
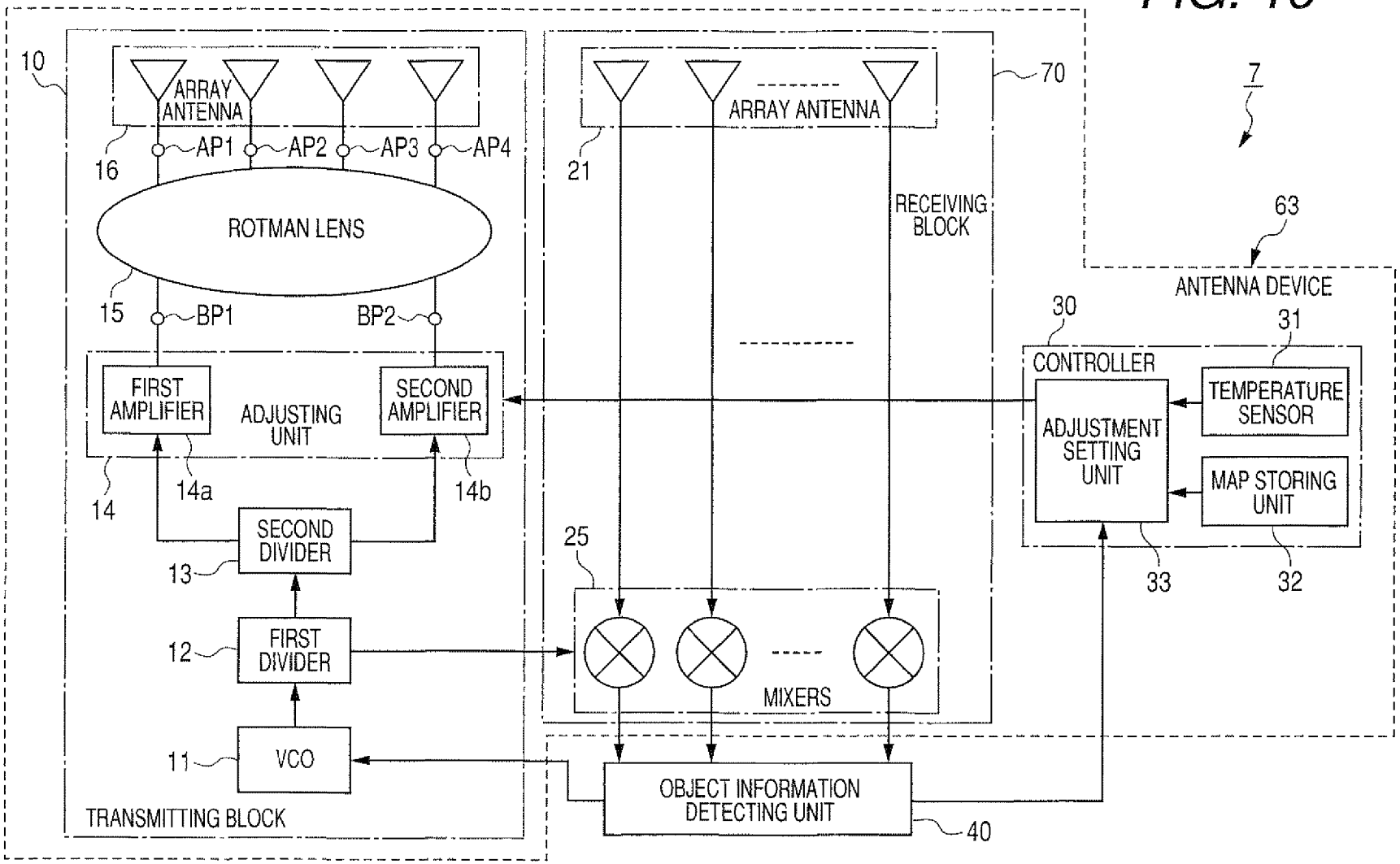
FIG. 10 is a block diagram of a radar apparatus having an antenna device according to another modification of the first embodiment.

FIG. 10 is a block diagram of a radar apparatus having an antenna device according to a modification of the first embodiment. As shown in FIG. 10, a radar apparatus 7 differs from the radar apparatus 1 shown in FIG. 1 in that an antenna device 63 of the apparatus 7 has a receiving block 70 in place of the block 20. The block 70 has the array antenna 21 and a plurality of mixers 25 connected with the respective antenna elements of the antenna 21. The storing unit 32 of the controller 30 has the maps corresponding to the transmitting block 10, and the setting unit 33 outputs instructions to the adjusting unit 14.

With this structure of the apparatus 7, a beam of electromagnetic waves coming from the particular direction is received in the antenna elements of the antenna 21. The beam received in the antenna elements has particular phase differences. The phase of the waves received in each antenna element differs from those received in the antenna elements.

In response to this beam reception, the antenna 21 produces an object signal in each antenna element. Each mixer 25 produces a beat signal from the signal of the corresponding antenna element and a local signal of the divider 12. The detecting unit 40 receives the beat signals of the mixers 25 and detects information about the object while using signal processing such as digital beamforming (DBF).

Accordingly, the receiving block of the antenna apparatus can be further simplified.

In the first to third embodiments, the beam is formed in the unit having a Rotman lens or dielectric lens to be radiated in the particular direction. However, the transmitting beam may be formed without using the Rotman lens or dielectric lens.

Figure 11:
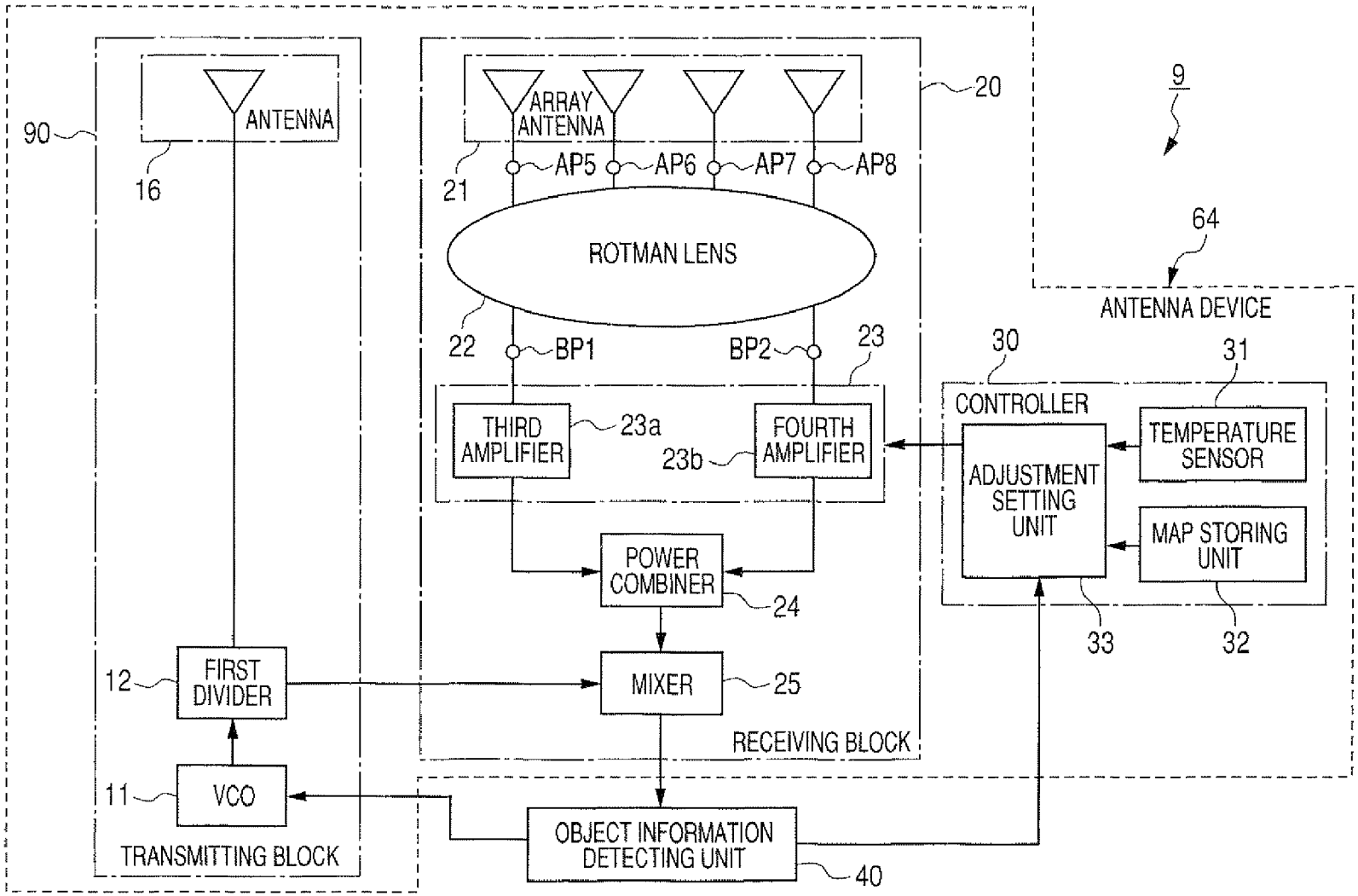
FIG. 11 is a block diagram of a radar apparatus having an antenna device according to another modification of the first embodiment.

FIG. 11 is a block diagram of a radar apparatus having an antenna device according to a modification of the first embodiment. As shown in FIG. 11, a radar apparatus 9 differs from the radar apparatus 1 shown in FIG. 1 in that an antenna device 64 of the apparatus 9 has a transmitting block 90 in place of the block 10. The block 90 has the VCO 11, the divider 12 and the antenna 16 having a single antenna element. The storing unit 32 of the controller 30 has the maps corresponding to the receiving block 2C, and the setting unit 33 outputs instructions to the adjusting unit 23.

With this structure of the antenna device 64, the array antenna 16 forms a beam of electromagnetic waves from electric power of the transmission signal outputted from the divider 12 and radiates the beam in a fixed direction. Electric power of this beam is composed of electric power of a first beam directed in the first direction and electric power of a second beam directed in the second direction.

When the receiving block 20 receives a beam coming from the fixed direction, the detecting unit 40 detects information about the object at the fixed bearing angle to the object corresponding to the fixed direction.

Accordingly, the antenna device 64 can radiate a beam in the fixed direction placed between the first and second directions and can produce a reception signal from the beam to detect information about the object.

Further, the transmitting block of the antenna apparatus can be further simplified.

In the antenna devices 63 and 64, the amplifiers 14*a* and 14*b* or the amplifiers 23*a* and 23*b* are used. However, the phase shifters 14*c* and 14*d* or the amplifiers 23*c* and 23*d* shown in FIG. 6 may be used in place of the amplifiers. In this case, the antenna device can radiate a beam in a direction different from the first and second directions or can receive a beam coming from a direction different from the first and second directions.

These embodiments should not be construed as limiting the present invention to structures of those embodiments, and the structure of this invention may be combined with that based on the prior art.

What is claimed is:

1. An antenna device comprising:

a beam forming unit which forms differently directed beams of electromagnetic waves and which includes an antenna surface for transmission and reception of said electromagnetic waves and a plurality of beam ports for input and output of radio frequency electrical signals;

at least two transmission signal adjusting units, each of which is coupled to a respectively corresponding one of said beam ports, and each of which adjusts at least one of amplitude and phase of signals being supplied to the beam forming unit via that beam port;

a transmission signal supplying unit that supplies transmission signals to each of the at least two transmission signal adjusting units;

a first beam control unit that sets an adjustment to be effected by each of the at least two transmission signal adjusting units so as to produce transmission beams formed by the beam forming unit having directivity along a thereby specified direction;

at least two reception signal adjusting units, each of which is coupled to a respectively corresponding one of said beam ports, and each of which adjusts at least one of amplitude and phase of signals being outputted from the beam forming unit via that beam port;

a reception signal producing unit that produces reception signals by synthesizing signals which are adjusted by the at least two reception signal adjusting units; and a second beam control unit that sets an adjustment to be effected by each of the at least two reception signal adjusting units so as to produce reception signals from the reception signal producing unit received by reception beams having directivity along said specified direction, wherein, in the beam forming unit, the plurality of beam ports are symmetrically located with respect to a plane perpendicular to an array direction thereof, and wherein the at least two beam ports used for transmission are spatially located inside the at least two beam ports used for reception.

2. The antenna device according to claim 1, wherein:

the transmission signal supplying unit includes a power divider that divides output from an oscillator to produce the transmission signals, the power divider including a transmission line and a resistor;

each of the at least two reception signal adjusting units includes a variable amplifier that adjusts amplitude of the transmission signals; and the first beam control unit sets the adjustment to be effected so that a sum of the transmission signal powers adjusted by each of the at least two transmission signal adjusting units is a constant value.

3. The antenna device according to claim 1, wherein:

each of the at least two transmission signal adjusting units includes a variable amplifier that adjusts a transmission signal amplitude; and the first beam control unit sets the adjustment amount to be effected so that a sum of the transmission signals adjusted by each of the at least two transmission signal adjusting units is a constant value.

4. The antenna device according to claim 1, wherein the reception signal producing unit includes a transmission line and a resistor.

5. The antenna device according to claim 1, further comprising:

a temperature sensor configured to detect an ambient temperature of the antenna device, wherein the beam forming unit corrects the adjustment to be effected based on the detected ambient temperature thereby compensating for an error between beam ports due to a temperature-dependent characteristic of the beam forming unit.

6. The antenna device according to claim 1, wherein the beam forming unit includes:

an antenna array that includes a plurality of antenna elements which are located on the antenna surface; and a Rotman lens that includes the plurality of beam ports and a plurality of antenna ports connected to each of the plurality of antenna elements.

7. The antenna device according to claim 1, wherein the beam forming unit includes:

a dielectric lens that is located on the antenna surface; and an array antenna that is located in position for transmission and reception of electromagnetic waves via the dielectric lens, which antenna array includes a plurality of antenna elements, each being connected to a respectively corresponding one of the plurality of beam ports.

* * * * *